United States Patent [19]

Mikhail

[11] Patent Number: 4,978,145

[45] Date of Patent: Dec. 18, 1990

[54] POSTAL STAMP, PROCESS, APPARATUS, AND METERING DEVICE, THEREOF

[76] Inventor: Ameer G. Mikhail, 2103 Windom Ct., Bel Air, Md. 21014

[21] Appl. No.: 346,233

[22] Filed: May 1, 1989

Related U.S. Application Data

[62] Division of Ser. No. 90,839, Aug. 28, 1987, Pat. No. 4,876,000.

[51] Int. Cl.[5] ..... B42D 15/00

[52] U.S. Cl. ..... 283/71; 283/81; 283/117

[58] Field of Search ..... 209/900; 283/71, 117, 283/81

[56] References Cited

U.S. PATENT DOCUMENTS

| | | | |
|---|---|---|---|
| 1,131,464 | 3/1915 | Besau | 283/71 |
| 3,774,758 | 11/1973 | Sternberg | 283/71 |
| 3,933,094 | 1/1976 | Morphy | 209/900 |
| 4,862,386 | 8/1989 | Axelrod et al. | 364/464 |

*Primary Examiner*—Paul A. Bell

[57] ABSTRACT

This invention enables the faster processing and sorting of mail pieces and packages while also detecting pieces with insufficient postage. A postal stamp is intoduced which has provisions for entering, by the stamp user, both the destination and origination identifier codes which are detectable by a scanning device. In addition, distinct markings are printed for alerting a scanning device to the location and orientation of the entered identifier codes. Furthermore, special marking code printed thereon is provided to identify the monetary value of the stamp. Two other different stamp structures are also introduced to help facilitate the stated objectives. These two other structures involve stamps of two layers with peel-off pieces. A mail sorting process and apparatus is provided which utilizes the capabilities of the introduced stamp. Finally, a postal metering device is improved and introduced as a compatible part of this invention.

3 Claims, 4 Drawing Sheets

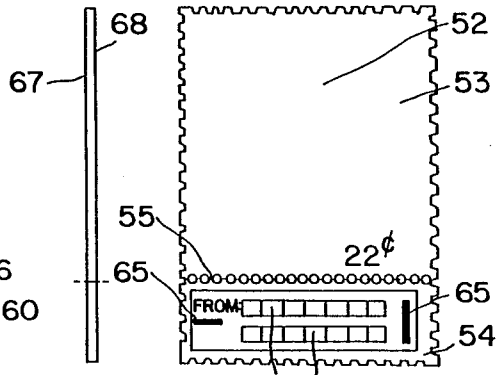
FIG. 7
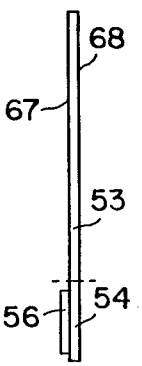
FIG. 8
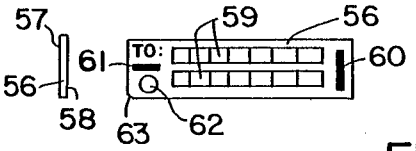
FIG. 9
FIG. 10
FIG. 11
FIG. 12
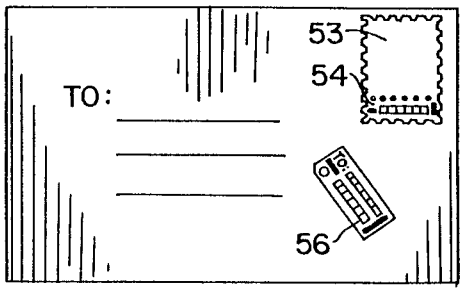
FIG. 15
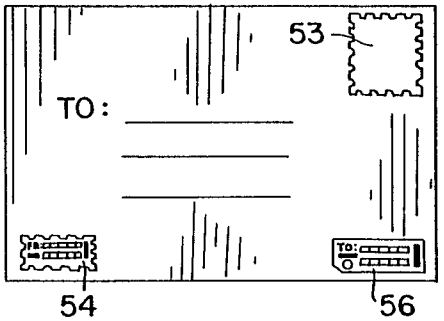
FIG. 14
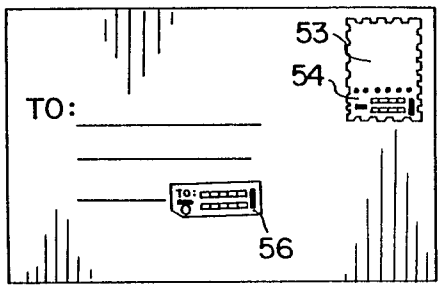
FIG. 13

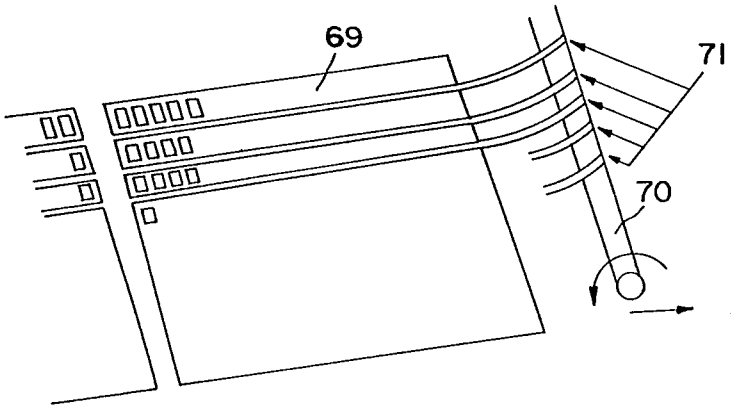
FIG. 16
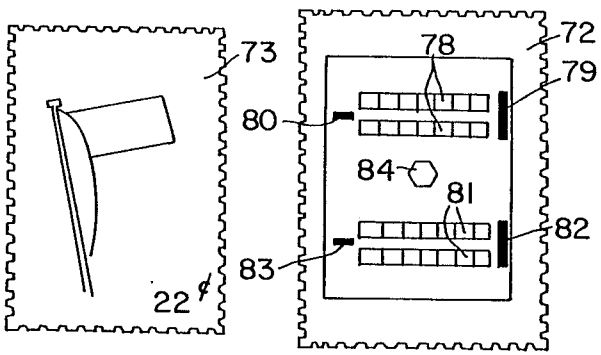
FIG. 21
FIG. 20
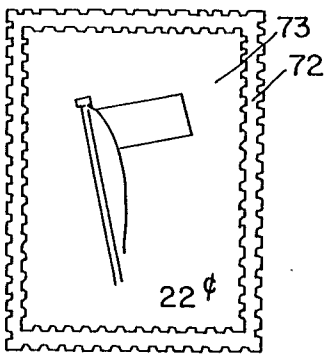
FIG. 17
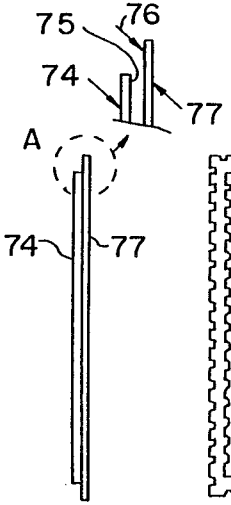
FIG. 19
FIG. 18

POSTAL STAMP, PROCESS, APPARATUS, AND METERING DEVICE, THEREOF

This application is a division, of application Ser. No. 07/090,839, filed Aug. 28, 1987, now U.S. Pat. No. 4,876,000.

BACKGROUND OF THE INVENTION

This invention relates to the fields of postal stamps (and decals), automated postal sorting processes, automated sorting machines, and postal metering devices.

This invention introduces a postal stamp or multi-pieces with provisions for entering, by the stamp user, machine readable origination (from) and destination (to) identifier codes. These provisions are made on a separable piece of the stamp which can be separated and removed away without interfering or destroying the beauty or the philatelic value of the stamp.

The stamp also has printed on it, a machine readable marking code which defines the monetary value of the stamp. The stamp also carries two distinct markings printed on it which act as a frame of reference to alert the scanning devices about the existence and location of the stamp on the package and provides the scanning devices with the angular orientation relative to a pre-set direction recognizable by the scanning machine.

In developing this stamp, emphasis was placed on preserving the appearance of the basic stamp, that is the stamp after removing pieces having the identifier codes and other markings for the important purpose of not affecting the philatelic value of the stamp for the stamp collectors. The stamp may be produced in the typical sheet form or may be produced in booklet form. A discount may be given for entering the destination identifier on the stamp or penalty may be imposed for not entering it.

This invention provides the description of a sorting process, where the information read by the scanning devices is utilized for processing the mail or packages.

This invention outlines a sorting apparatus (machine) that facilitates the use of the information entered and those printed on the stamp. This apparatus is constructed to perform the following functions:

(1) Sort mail pieces automatically, without human intervention, according to their entered destination identifier codes; and (2) Compute the postage fee required for each mail piece and compare it to the postage value affixed to the mail piece. If postage is due, the mail piece may be marked accordingly before routing to a special container for further special processing.

Finally, this invention introduces a postal metering device which prints indicia for entering the origination and destination identifiers in addition to the stamp monetary postal fee code on the metering tape. This printing is in addition to the typical postal value seal and the usual round seal identifying the postal office name and the date printed on the metering tape.

SUMMARY OF THE INVENTION

The present invention represents improvements over the prior art of postal stamps, such as that of Sternberg (U.S. Pat. No. 3,774,758, issued November, 1973), Murphy et al (U.S. Pat. No. 3,993,094, issued January 1976, and Besau (U.S. Pat. No. 1,131,464 issued March 1915). This invention also provides improvements over the previous invention of Mikhail (U.S. patent application No. 819,298 filed on Jan. 16, 1986 now U.S. Pat. No. 4,715,622) in the areas mentioned below.

This invention introduces a stamp having provisions for entering both the origination as well as the destination identifier codes. The destination identifier will be used to sort the mail and packages to their intended destinations. The origination identifier will be used, together with the destination identifier, in determining the postal distance between these two geographical locations defined by these two identifier codes.

The introduced stamp includes a pre-printed marking code indicating its postal monetary value. This marking code is such that it can be detected and read by an appropriate scanning device. The scanning device would also be able to read plurality of stamps on the package and then add their values together. This will enable the determination if postage is due on that package.

This invention describes a mail-package sorting process. This process utilizes the new features of the introduced stamp as described in the preceding two paragraphs.

This invention provides the outlines of a mail-package sorting apparatus which is invented to utilize the new features of the new stamp as described in the above mentioned preceding first two paragraphs above and also to utilize the new sorting process described in the immediate preceding paragraph.

This invention describes a postal metering device which prints indicia for both the destination and origination identifiers code and the monetary value of the fee on the metering tape which is affixed to mail pieces. This printing is in addition to the usual printings of the monetary value seal and the seal for the date and the name of the post office.

BRIEF DESCRIPTION OF THE DRAWINGS

The drawings for the invention are as follows:

FIG. 7 shows a front view of the sixth embodiment of a stamp structure;

FIG. 8 shows a side view of the sixth embodiment of the stamp of FIG. 7;

FIG. 9 shows an enlargement of a detail of FIGS. 7 and 8;

FIG. 10 shows side view of a piece of FIG. 9;

FIG. 11 shows a piece of the stamp of FIG. 7;

FIG. 12 shows a side view of a piece of the stamp of FIG. 11;

FIGS. 13, 14 and 15 show examples of the different applications of stamp number mail pieces;

FIG. 16 shows a schematic for a method for the production of stamp of FIG. 7 with regard to affixing the removable destination identifier piece to the main stamp sheet;

FIG. 17 shows a front view of a seventh stamp embodiment and its components.

FIG. 18 shows a side view of the stamp of FIG. 17;

FIG. 19 shows a detail "A" of FIG. 18;

FIG. 20 shows a piece of the stamp of FIG. 17;

FIG. 21 shows a piece of the stamp of FIG. 17;

DETAILED DESCRIPTION OF THE INVENTION

Figure 3:
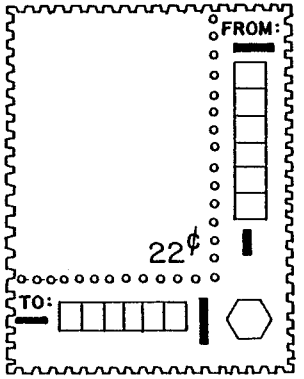
FIGS. 3, 4, 5 and 6 show front views of a second, third, fourth and fifth embodiments of the first embodiment of the stamp of FIG. 1, respectively.

Several definitions and terminologies are used in this disclosure and they are provided as follows:

POSTAL STAMP—Means also 'postal decal' and generally [decal].

MAIL PIECE—Is not limited in meaning to the ordinary enveloped mail in the typical sizes but rather used in the wider sense of parcels and packages as well.

MAIL—Does not refer to government own postal service only, but rather includes private companies handling mail or parcel service and overnight delivery services.

DESTINATION IDENTIFIER—Means any code which is deviced to designate geographical locations, and is not limited to the familiar five-digit zip code known and used in the United States. It includes, but not limited to, the new nine-digit zip code recently introduced and used in the United States. It also includes the six alphanumeric character/digit code that is used in Canada and Great Britain. For mail destined to foreign countries, a code can be deviced from the first, e.g., five characters in the name of that country. France would be coded as 'FRANC' and Germany would be coded as 'GERMA'.

MACHINE READABLE—Refers to any automated or semi-automated tool or equipment that may be connected closely or remotely to any device or computer with any optical or non-optical scanning or 'reading' ability. Many types of 'reading' machines do exist today and are routinely used in supermarkets or in schools for grading examinations or for counting votes. Description of the techniques or capabilities of these machines is beyond the scope of this invention.

MAIL PIECE—Refers not only to typical envelopes of all sizes, but also to packages, parcels and the like.

POSTAL FEE MARKING CODE—Refers to any numerals, bar-code, color code, geometric shape code, or any other code system that can be detected and read by the appropriate device to identify the postage monetary value of the stamp (or decal).

MAILING CENTERS—Refers to any center for collecting, sorting, and distributing of mail pieces for transferring to other destinations. Examples are the U.S. Postal Offices, express mail centers, next day delivery organizations, and private companies dealing with special or fast delivery services.

POSTAL DISTANCE—Refers to the distance based on which the postage fee is calculated according to the pre-set fee tables of the postal service or the general carrier. This distance may be determined based on the geographical distance as determined by the difference between the origination and destination location identifiers (e.g. zip codes).

This invention discloses three structures of postal stamps with provisions for entering origination and destination identifier codes by the stamp user and with a code indicating the monetary value of the stamp. Both codes will enable the automatic sorting of mail pieces.

This invention also describes a process for sorting the mail using the new capabilities of the introduced stamps.

The invention also outlines a mail sorting apparatus which utilizes the new capabilities of the introduced stamps as well as the new sorting process introduced.

Figure 2:
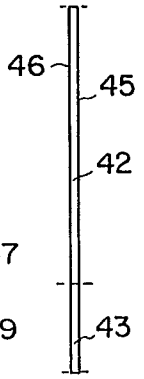
FIG. 2 shows a side view of the stamp of FIG. 1.
Figure 1:
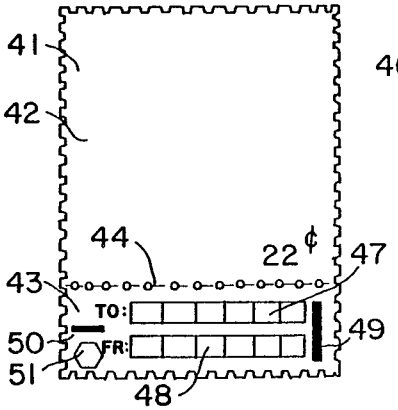
FIG. 1 shows a front view of the first embodiment stamp structure.
Figure 4:
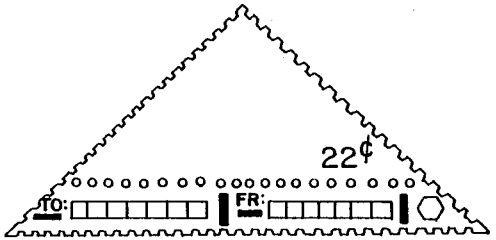
Figure 6:
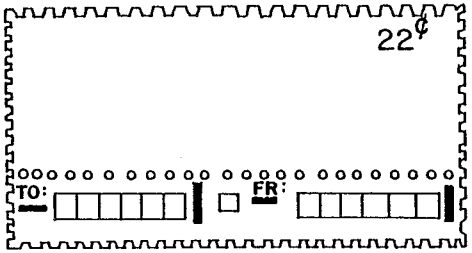
Figure 5:
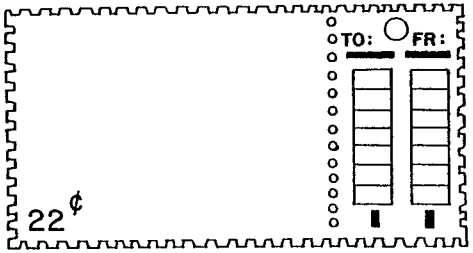

Referring now to FIGS. 1 and 2 for the first stamp structure, stamp 41 is shown which is separable into at least two parts 42 and 43 through at least one weakened or perforated line 44. The stamp 41 has on one of its surfaces 45, drawings, characters and symbols identifying the country of origin and the monetary value of the stamp. The second surface 46 may be coated with a bonding material that permanently sticks to mail piece surfaces. One piece of the stamp 43 has marking indicia 47 and 48 for entering both the destination and origination identifiers (e.g. zip codes) which identify both the receiving and originating mail centers.

These indicia may be marked by "to" and "from" to enable the stamp user to properly enter each identifier. These two identifiers are positioned between two distinct (different) markings 49 and 50 which may be specially color printed specially coated to allow triggering of the appropriate scanning device.

These two distinct markings are used as a frame of reference for said scanning device to allow the proper reading of both identifiers. These two markings should not be identical to enable the scanning device of detecting the orientation of said markings. The same piece 43 of said stamp also carries a marking code identifying the monetary value of the stamp, which is also detectable and readable by the same or a different scanning device.

Other variations of this stamp arrangement are shown in FIGS. 3, 4, 5 and 6, where the same components described above are varied in shape, position, and location on the stamp. These variations are not meant to be the only ones. Any person skilled in the art can produce a different combination which is still covered under this invention.

The second stamp structure is shown in FIG. 7. The stamp 52 is separable into at least two pieces 53 and 54 through at least one weakened line 55. Another piece of thin material 56 is attached to one piece of the stamp, piece 54, by a special glueing material which allows the removal (peeling off) and reaffixation of said piece without damaging neither the surface it is affixed to nor the piece 54 itself.

Referring now to FIG. 9, there is shown a piece 56 having the two surfaces 57 and 58 where surface 57 is over printed with the indicia 59 for the destination identifier (marked by the printed word "to"), the two distinct markings 60 and 61 for the reference frame, and the monetary value marking code 62.

The other surface 58 is coated with the previously described adhesive material which allows the removal of the piece 56 and the re-affixation of it to other surfaces. Piece 56 has also an edge 63 cut at an angle to help in peeling piece 56 off piece 54. The main stamp piece 52 which comprises the two pieces 53 and 54, is shown in FIG. 11 where piece 54 carries the printed indicia 64 for the destination identifier marked by the printed word "from". Piece 54 also carries the two distinct reference frame markings 65 and 66. This stamp 52 has the two surfaces 67 and 68 where surface 68 is coated with a bonding material which permanently adheres to the surfaces cf mail pieces. Surface 67 may be over-printed with drawings, characters and symbols identifying the country of origin and the monetary value among other things.

The stamp described in FIGS. 7 to 12 can be used in different ways on letters and packages as shown in FIGS. 13, 14 and 15.

FIG. 13 shows the peel-off piece 56 being separated from the stamp and affixed in the location where the destination identifier is usually written. FIG. 14 shows another application where the two pieces 54 and 56 are separated from the stamp and from each other, and are affixed in different locations which may be specified or required if it makes the detection and scanning processes more effective. FIG. 15 shows another application where the peel-off piece 56 which carries the destination identifier is placed at any location and at a random orientation angle to represent a more practical application.

A possible process for manufacturing the stamp of FIGS. 7 to 12 is outlined in FIG. 16. A long cylinder 70 carrying several long tapes 71 of the peel-off piece 56, is to move across the postal sheet 69 while being rotated in a manner to allow the unwinding of the tapes to fall and stick to the postal stamp sheet at the required positions. The tapes may be cut by a long knife edge (not shown in the figure) which is positioned at the end of the stamp sheet.

A third stamp structure is depicted in FIG. 17. The stamp is composed of two layers of equal or different dimensions 72 and 73 of thin materials. On the frontal surface 74 printed are some drawings and symbols identifying the country of origin and the monetary value of the stamp. The bottom surface 77 of the second piece 72 is coated with a bonding material which permanently adheres to surfaces it is attached to. The second surface 75 of the frontal piece 73 is coated with a special glueing material that allows the peeling-off of piece 73 from piece 72. Surface 76 of the bottom piece 72 is such that it permits the non-sticking of the glue of the surface 75, and also permits the writing on said surface 76.

FIG. 20 shows the stamp piece 73 while FIG. 21 shows piece 72 with its exposed surface 76 having the printed origination identifier indicia 78 positioned between the two distinct frame of reference markings 79 and 80. FIG. 21 also shows the printed indicia 81 for the destination identifier positioned between the two distinct markings 82 and 83 for the reference frame. It also shows a symbol 84 of the monetary value code for the stamp.

Figure 23:
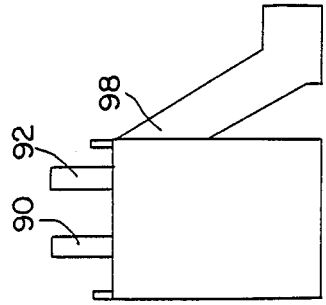
FIG. 23 shows a side view of the sorting apparatus of FIG. 22.
Figure 22:
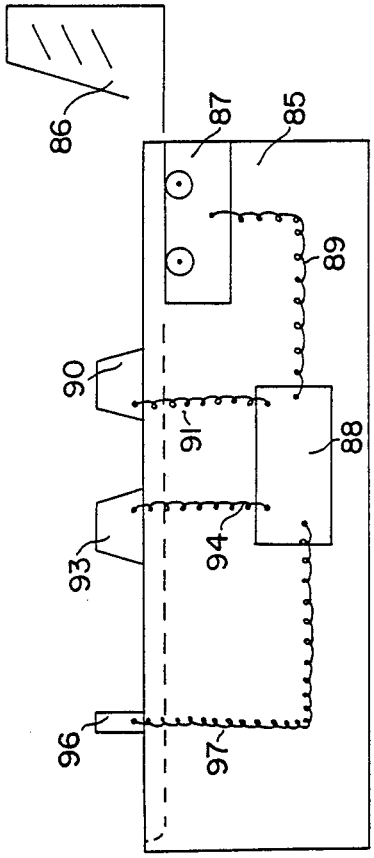
FIG. 22 shows a schematic diagram for a sorting apparatus.
Figure 24:
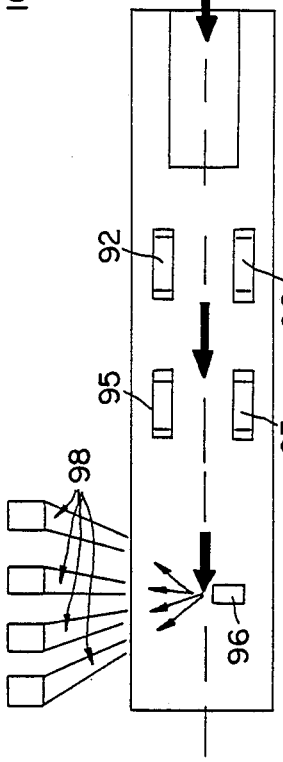
FIG. 24 shows a plan view of the sorting apparatus of FIG. 22.

A postal sorting apparatus 85 is outlined in FIGS. 22, 23 and 24 as having a hopping device 86 for feeding the mail pieces into the apparatus and having a weighing scale 87 which is attached to a computing board 88 by a wire 89. The apparatus also has a scanning device 90 which can detect and read the origination and destination identifiers entered on the stamp on the mail piece.

This scanning device is attached to the computing board 88 by a wire 91. There may be a second scanning device 92, similar to the first one 91, which may be positioned across from the mail stream path. This is in order to be able to detect the identifier codes on stamps which are affixed on either side of a mail piece.

Another third scanner 93 may be positioned downstream from the first two, which is to be able to detect and read the marking code of the monetary value printed on each stamp. This third scanner is connected to the computing board 88 by a wire 94. A fourth scanner 95, similar to the third one 93, may be positioned across from the third scanner 93 and across from the mail stream path in order to be able to detect markings on stamps that are affixed on either side of a mail piece. A pushing mechanism 96 is located downstream of all scanning devices. This mechanism is connected to the computing board 88 by a wire 97.

The pushing mechanism 96 receives its signal from the computing board 88 which collects the information sent to it from the scale 87 and the four scanners 90, 92, 93 and 95 and then forwards it to the pushing mechanisms 96. The pusher mechanism pushes the mail pieces, according to their received information, into the appropriate containers 98 designated for that particular destination read from the stamp.

The component of this apparatus may be rearranged in any order so as to allow the ease, convenience, and efficiency of the mail sorting process. The two scanning devices 90 and 93 (also 92 and 95) may be combined in one device. The weighing scale 87 may be placed downstream of the scanners instead of upstream of them. Any person skilled in the art may rearrange or add to this outlined apparatus in order to facilitate the best performance possible from the apparatus. In other arrangement of the apparatus, the scanners may be portable and hand-held to enable a human operator to scan large parcels which may not fit in the mail stream space.

A mail sorting process which executes the following processing steps is described to:

(1) Sort the mail according to their entered destination identifiers on the stamps;

(2) Weigh the mail pieces;

(3) Calculate the postal distance as determined by the difference between the two entered destination and origination identifiers;

(4) Detect and sums the monetary value of all the stamps affixed on the mail piece, using the preprinted marking code on each stamp;

(5) Combine the weight measured in step 2 with the computed postal distance of step 3, for determining the exact required postage based on pre-set rates imposed by the postal service or the governing organization;

(6) Compare the total value of postage affixed to the mail piece, as detected in step 4, with the required postage for that mail piece as determined in step 5; and (7) Route the underpaid (i.e. postage due) mail pieces to a special container for further special processing, or mark them accordingly before routing to that special container.

Figure 25:
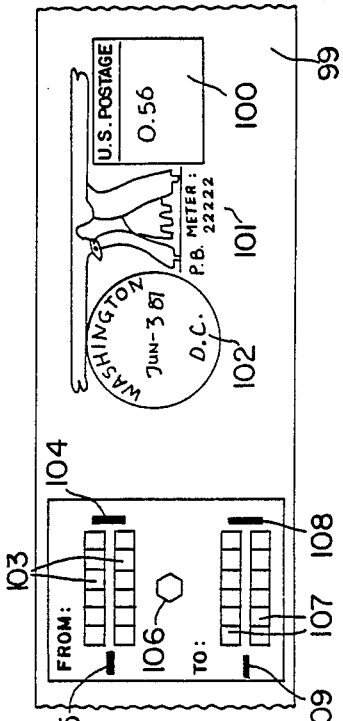
FIG. 25 shows a postal metering tape with the printed indicia for entering the origination and destination identifier codes and a symbol code for the monetary value of the postage fee.

The improved postal metering device is to print on the metering tape 99 (of FIG. 25) several new items. In addition to the postal seal 60, the meter device number 101 and the round seal 102 of the date and name of the post office, this device may print: Indicia 103 for the origination identifier, two distinct markings 104 and 105 for reference frame, the monetary value code 106 of the postal fee, indicia 107 for the destination identifier which may be positioned between another two distinct markings 108 and 109 used as frame of reference. The metering device may be also modified to enter the origination identifier code by printing them in the provided indicia. This is possible because the origination identifier code is known at each location and may not change for that metering device.

What is claimed:

1. A postal stamp comprising:

a sheet of thin material having two surfaces, one of said surfaces being coated with an adhesive;

said sheet containing a line of perforations such that said sheet may be separated into at least two pieces;

a first piece of said sheet having first indicia for defining the attributes of said stamp, said indicia being carried on the surface of said piece not coated with said adhesive;

a second piece of said sheet having second indicia defining an area for emplacement of identification indicia identifying both an origination and a destination mailing center, whereby when the identification indicia have been emplaced in said area, the identification indicia can be detected by a scanning device;

said second piece of said sheet further having third indicia comprising at least one distinct marking printed for use as a reference frame to alert a scanning device in determining the location and orientation of the identification indicia; and said second piece of said sheet having fourth indicia printed thereon which indicia is machine readable and defines the monetary value of the stamp.

2. A postal stamp comprising:

a sheet of thin material having two surfaces, one of said surfaces being coated with a first adhesive means;

said sheet containing a line of perforations such that said sheet may be separated into at least two pieces;

a first piece of said sheet having first indicia for defining the attributes of said stamp, said indicia being carried on the surface of said piece not coated with said adhesive means;

a second piece of said sheet having second indicia defining an area for emplacement of identification indicia identifying both an origination and a destination mailing center, whereby when the identification indicia have been emplaced in said area, the identification indicia can be detected by a scanning device;

said second piece of said sheet further having third indicia comprising at least one distinct marking printed for use as a reference frame to alert a scanning device in determining the location and orientation of the identification indicia;

said second piece of sheet having fourth indicia printed thereon which indicia is machine readable and defines the monetary value of the stamp; and said second, third and fourth indicia being carried on a second sheet which sheet is removably adhered to said second piece by a second adhesive means which allows said second sheet to be removed from said second piece and readhered to another surface.

3. A postal stamp comprising:

at least two sheets of thin material attached together by a non-permanent adhesive means which allows the easy separation of said at least two sheets, without damages any of said sheets;

an exposed surface of one of said adhered sheets having first indicia defining the attributes of said stamp;

an exposed surface of another of said adhered sheets having second adhesive means thereon for adhering the stamp to a desired piece of mail;

the covered surface of said another sheet having second indicia thereon which indicia defines an area for emplacement of identification indicia identifying both an origination and a destination mailing center, whereby when the identification indicia have been emplaced in said area, the identification indicia can be detected by a scanning device;

said covered surface further having third indicia comprising at least one distinct marking printed for use as a reference frame to alert a scanning device in determining the location and orientation of the identification indicia; and said covered surface further having fourth indicia printed thereon which indicia is machine readable and defines the monetary value of the stamp.

* * * * *